US005569078A

United States Patent [19]

Kirkpatrick

[11] Patent Number: 5,569,078

[45] Date of Patent: Oct. 29, 1996

[54] AIR DIFFUSER HAVING FIXED AND VARIABLE OUTLET PORTS

[75] Inventor: Allan T. Kirkpatrick, Fort Collins, Colo.

[73] Assignee: Colorado State University Research Foundation, Fort Collins, Colo.

[21] Appl. No.: 399,131

[22] Filed: Mar. 6, 1995

[51] Int. Cl.[6] ..... F24F 13/072

[52] U.S. Cl. ..... 454/292; 454/304

[58] Field of Search ..... 454/256, 292, 454/304

[56] References Cited

U.S. PATENT DOCUMENTS

| | | | |
|---|---|---|---|
| 3,641,915 | 2/1972 | Jardinier et al. . | |
| 3,768,395 | 10/1973 | Rick . | |
| 3,768,919 | 10/1973 | O'Connor . | |
| 3,799,694 | 3/1974 | Duzan . | |
| 3,841,789 | 10/1974 | Corrigan et al. . | |
| 3,865,021 | 2/1975 | De . | |
| 3,992,128 | 11/1976 | Lunsford et al. . | |
| 4,133,213 | 1/1979 | Brandt, Jr. . | |
| 4,214,512 | 6/1980 | McCall . | |
| 4,259,898 | 4/1981 | Finkelstein et al. | 454/292 |
| 4,362,091 | 12/1982 | Cox . | |
| 4,373,919 | 2/1983 | Stangeland . | |
| 4,475,446 | 10/1984 | McCall . | |
| 4,527,949 | 7/1985 | Kirtland . | |
| 4,616,559 | 10/1986 | Barlow . | |
| 4,648,552 | 3/1987 | Carlson et al. . | |
| 4,671,170 | 6/1987 | Price . | |
| 4,679,495 | 7/1987 | Locker . | |
| 4,694,989 | 9/1987 | Carlson et al. . | |
| 4,714,009 | 12/1987 | DeHart et al. . | |
| 4,726,733 | 2/1988 | Scampini . | |
| 4,800,804 | 1/1989 | Symington . | |
| 4,811,656 | 3/1989 | Meendering | 454/292 X |
| 4,815,362 | 3/1989 | Ishizuka et al. . | |
| 5,052,285 | 10/1991 | Rich . | |
| 5,088,388 | 2/1992 | Schaefer | 454/304 X |
| 5,141,473 | 8/1992 | Swaney . | |
| 5,259,817 | 11/1993 | Schumacher et al. . | |
| 5,297,326 | 3/1994 | Kline . | |

FOREIGN PATENT DOCUMENTS

| | | | |
|---|---|---|---|
| 2804670 | 6/1979 | Germany | 454/292 |
| 3600821 | 7/1986 | Germany | 454/292 |
| 7409194 | 11/1973 | Netherlands . | |

OTHER PUBLICATIONS

Equipment Handbook, Chapter 2, "Air–Diffusing Equipment", American Society of Heating, Refrigerating and Air–Conditioning Engineers, Inc. (1988).

*Primary Examiner*—Harold Joyce

*Attorney, Agent, or Firm*—Flehr, Hohbach, Test, Albritton & Herbert

[57] ABSTRACT

A diffuser introduces air into a conditioned space to obtain a desired indoor atmospheric environment. The diffuser has a diffuser body and an inlet through the diffuser body. The inlet has an inlet area to receive the air within the diffuser. The diffuser has a primary outlet through the diffuser body. The primary outlet has a fixed primary area to direct air from within the diffuser into the conditioned space. The diffuser has a secondary outlet through the diffuser body. The secondary outlet is provided to direct the air from within the diffuser into the conditioned space. The secondary outlet has a secondary area that is adjustable in size between a predetermined minimum secondary area and a predetermined maximum secondary area. The predetermined minimum area may be chosen to be zero to provide for a fully closed secondary outlet when the secondary area is adjusted to its minimum area. The diffuser may be implemented with a plurality of primary outlets and a plurality of secondary outlets.

18 Claims, 11 Drawing Sheets

Two Way Throw Pattern

Four Way Throw Pattern

AIR DIFFUSER HAVING FIXED AND VARIABLE OUTLET PORTS

BACKGROUND OF THE INVENTION

1. Field of Invention

This invention relates generally to air diffusers which supply conditioned air to rooms. More specifically, this invention provides an air diffuser having a fixed area primary outlet and a secondary outlet having an area which is variable to increase with increased air flow rate through the diffuser.

2. Description of the Related Art

In order to achieve a desired indoor environment, an effective supply of conditioned air is required. Various types of air diffusing equipment, commonly known as diffusers, have been developed to supply this conditioned air to rooms. The performance of a diffuser is determined by its throw, which is the distance from the diffuser outlet to the location in the room where the diffuser velocity has decreased to a specified value. The proper throw must be maintained in order to adequately mix the air and to produce proper ventilation and thermal conditions in the room. However, achieving the proper throw can be difficult if the air flow rate through the diffuser is variable. Variable air flow results from the use of a variable air volume system. A variable air volume system has a control system which varies the air flow rate to match the changes in the cooling or heating requirement of an indoor environment. As the heating or cooling requirement is reduced, the air flowrate is correspondingly reduced, and vice versa.

Conventional air diffusers supply conditioned air through a constant area outlet. If the flow rate through such an outlet decreases, the throw distance is reduced. If the throw distance is reduced, it is difficult to maintain the desired ventilation and temperature distribution. Also, in cold air distribution systems, if the throw distance is reduced to less than the separation distance of the outlet jet of the diffuser, the outlet jet can separate or dump, causing thermal comfort problems.

SUMMARY OF THE INVENTION

The invention is a diffuser for introducing air into a conditioned space to obtain a desired indoor atmospheric environment. The diffuser has a diffuser body, an inlet through the diffuser body, a primary outlet through the diffuser body, and a secondary outlet through the diffuser body. The inlet has an inlet area to receive the air within the diffuser. The primary outlet has a fixed primary area to direct air from within the diffuser into the conditioned space. The secondary outlet is provided to direct the air from within the diffuser into the conditioned space. The secondary outlet has a secondary area that is adjustable in size between a predetermined minimum secondary area and a predetermined maximum secondary area. The predetermined minimum area may be chosen to be zero to provide for a fully closed secondary outlet when the secondary area is adjusted to its minimum area. The diffuser may be implemented with a plurality of primary outlets and a plurality of secondary outlets. The diffuser may be implemented with the angle between the primary and secondary outlets being ninety degrees using a four sided configuration. The diffuser may also be implemented with additional sides so that the angle between the primary and secondary outlets can have a value between zero and ninety degrees.

DETAILED DESCRIPTION OF THE PRESENT INVENTION

Figure 1:
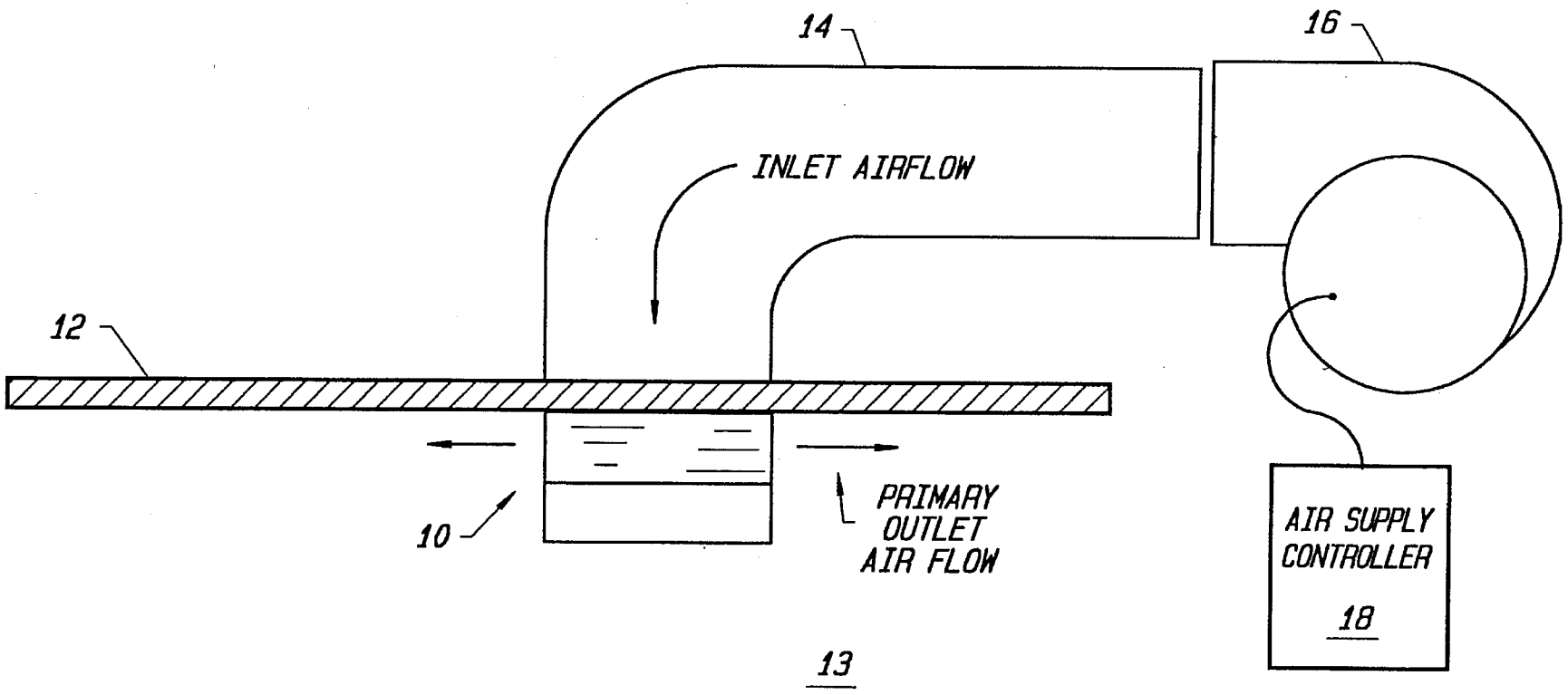
FIG. 1 is a schematic drawing illustrating the relationship between the diffuser of the invention and other components in an air conditioning system.

FIG. 1 is a schematic drawing illustrating the relationship of a diffuser 10 with other components in an air conditioning system. Diffuser 10 is in fluid communication with air supply means 16 by way of air supply duct 14. Diffuser 10 is disposed such that it passes through an opening in ceiling 12. Diffuser 10 could similarly be disposed to pass through an opening in a wall (not shown). Air supply controller 18 controls air supply means 16 such that air supply means 16 provides selectable variable levels of air flow through air supply duct 14 to diffuser 10. Air supply controller 18 in controlling air supply means 16 provides a mechanism for increasing or decreasing, as desired, air flow through diffuser 10. Inlet air flow is illustrated by an arrow within air supply duct 14 to indicate a direction of flow to diffuser 10. Air that passes through diffuser 10 enters conditioned space 13 which is, for example, an inhabited room within a dwelling. Air passing through diffuser 10 can be cool or warm, as desired, with respect to the temperature of conditioned space 13. Accordingly, diffuser 10 is used to provide a desired indoor atmospheric environment.

Figure 2:
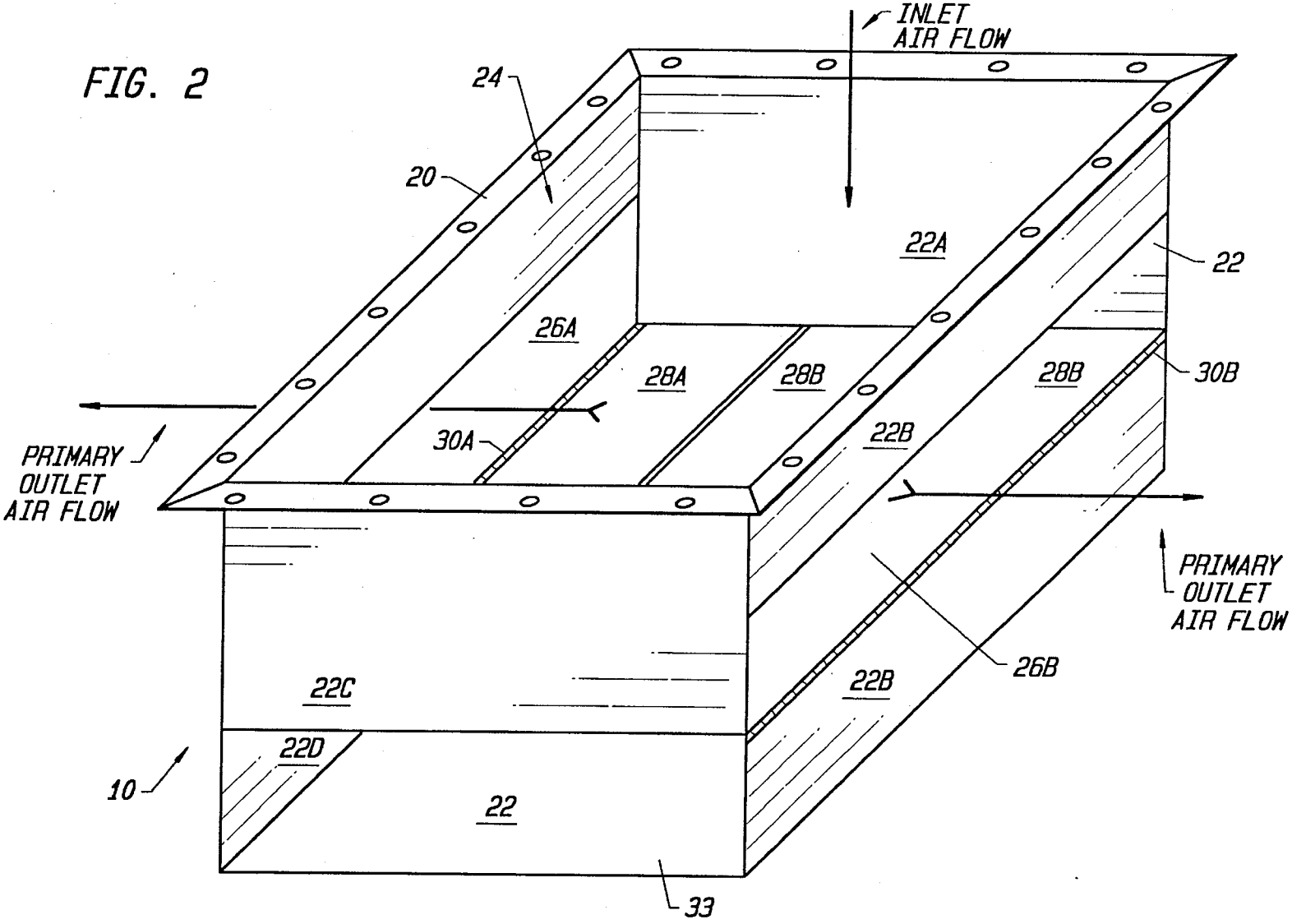
FIG. 2 is a perspective view of a diffuser, in accordance with the invention, with closed secondary outlets.

FIG. 2 is a perspective view of diffuser 10. It can be observed that diffuser 10 is illustrated as a cube shaped structure. Although the shape of diffuser 10 can be varied within the spirit of this invention, it will be convenient to refer in this specification to locations on diffuser 10 as if they correspond to different faces of a cube.

Diffuser body 22 may be constructed of sheet metal wall panels including a first wall **22*d*, a second wall 22*b*, a third wall 22*a*, and a fourth wall 22*c*. Preferably, flange 20 is attached to diffuser body 22 to provide a fastening mechanism. Diffuser 10 is fastened to air supply duct 14 by way of flange 20. The rectangular area defined by flange 20 can be considered to be an inlet 24 having an inlet area to receive air within diffuser 10. Air thus passes from air supply duct 14 through inlet 24 into diffuser 10. The inlet area defined by flange 20** is located at what would correspond generally to the top face of a cube.

First primary outlet 26A and second primary outlet 26B are apertures through diffuser body 22. As pictured in FIG. 2, first primary outlet 26A is located on what would correspond generally to the left face of a cube, while second primary outlet 26B is located on what would correspond to the right face of a cube. Diffuser body 22 has a fixed primary area which is the area of the aperture provided by first primary outlet 26A. As pictured in FIG. 2, first primary outlet 26A is rectangular shaped. Second primary outlet 26B has a similar size, shape, and function as first primary outlet 26A. In one embodiment, first primary outlet 26A and second primary outlet 26B are rectangular apertures having a height to width ratio that is approximately one third of the overall height to width ratio of the diffuser body 22. It should be understood that a diffuser 10 could be implemented with only a single primary outlet.

First primary outlet 26A directs air from within diffuser 10 into conditioned space 13. Inlet air flow from air supply duct 14 (not shown in this figure) into diffuser 10 is illustrated by the vertical arrow labeled "inlet air flow." The interior of diffuser 10 provides an unobstructed fluid communication path for air flow from inlet 24 through first primary outlet 26A and second primary outlet 26B. An arrow pointing to the left illustrates primary outlet air flow through first primary outlet 26A while an arrow pointing to the right illustrates primary outlet air flow through second primary outlet 26B.

First vane 28A (also referred to as "a first floor segment") and second vane 28B (also referred to as "a second floor segment"), as illustrated in FIG. 2, are positioned to prevent flow of air past first vane 28A and second vane 28B. Accordingly, as so illustrated, these vanes cause any air passing through diffuser 10 to exit diffuser 10 by way of first primary outlet 26A and second primary outlet 26B. First vane 28A is hinged to and within diffuser body 22 by hinge 30A along the lower edge of rectangular first primary outlet 26A. As pictured, first vane 28A is fastened along the side of diffuser 10 that would correspond to the left face of a cube. Second vane 28B is hinged to and within diffuser body 22 by hinge 30B along the lower edge of rectangular second primary outlet 26B. Second vane 28B is fastened along the side of diffuser 10 that would correspond to the right face of a cube. As will be illustrated in subsequent figures, first vane 28A and second vane 28B swing on their respective hinges in the fashion of a double door to provide a closeable passage through which air within diffuser 10 can pass. As illustrated in this figure, the closeable passage is closed.

Passage 33 is defined by diffuser body 22. Passage 33 is defined by wall panels on what would correspond to the left, right, and bottom faces of a cube. Passage 33 is illustrated as a vacant space having a rectangular aperture in the foreground of the figure, that is, at what would correspond to the front face of a cube. Not visible in this drawing, passage 33 extends through diffuser 10 to the side of diffuser 10 that would correspond to the rear face of a cube. The vacant space provided by passage 33 is shown bounded above by first vane 28A and second vane 28B. Passage 33 is provided to allow space for first vane 28A and second vane 28B to swing into and also to provide an alternate path of air flow through diffuser 10 when first vane 28A and second vane 28B are opened.

Figure 3:
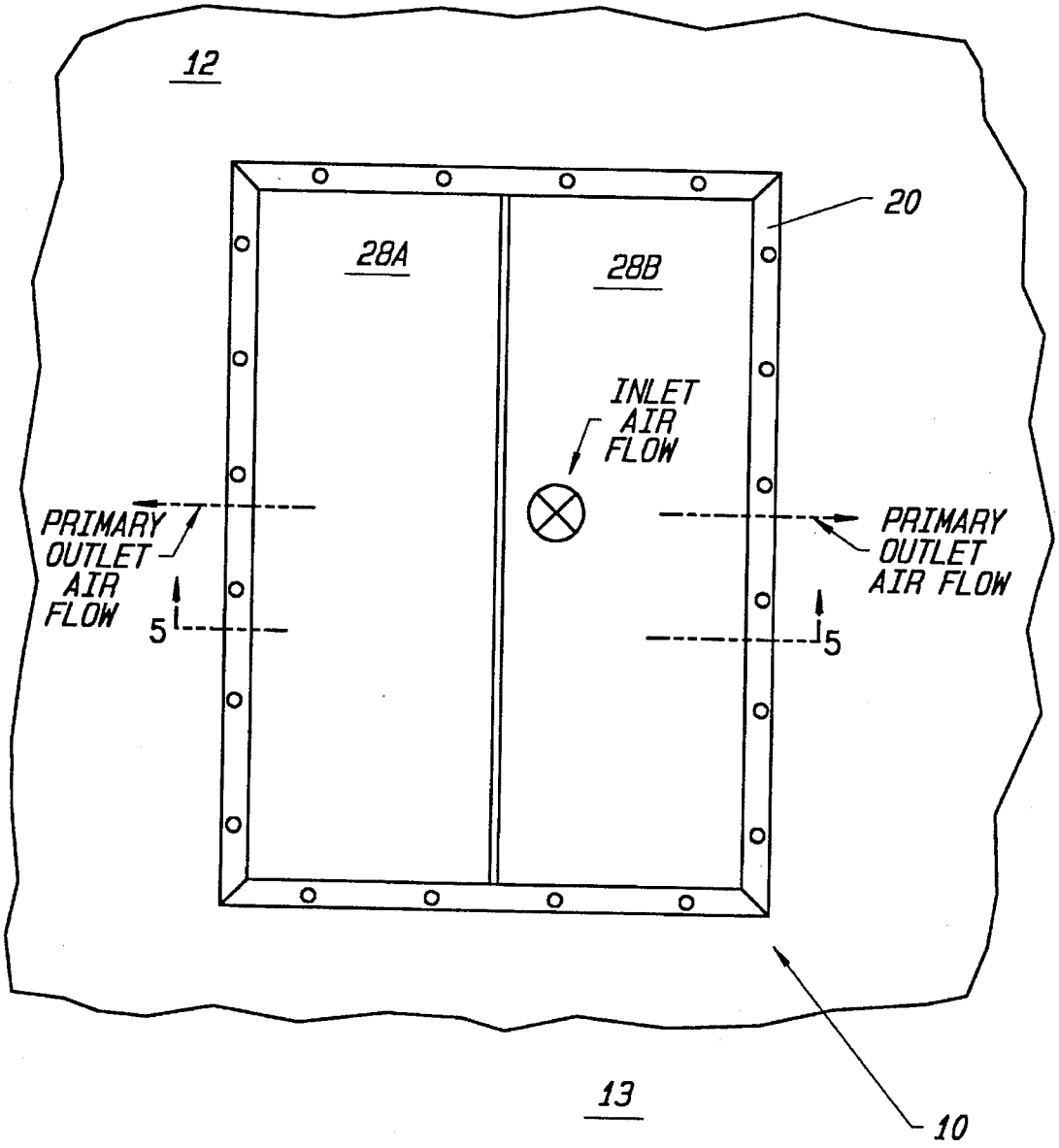
FIG. 3 is a plan view of a diffuser, in accordance with the invention, with closed secondary outlets.

FIG. 3 is a plan view of diffuser 10. Inlet air flows downward in the direction of the paper and is so signified by the circled "X." The approximately square cross section of diffuser 10 is illustrated, but other cross section shapes could be conveniently adapted in accordance with the invention. As shown in this figure, first vane 28A and second vane 28B are in the closed position to prevent air from passing downward beyond the vanes. Air flow into conditioned space 13 is illustrated by leftward and rightward pointing arrows to indicate air flow from diffuser 10 through first primary outlet 26A and second primary outlet 26B.

Figure 4A:
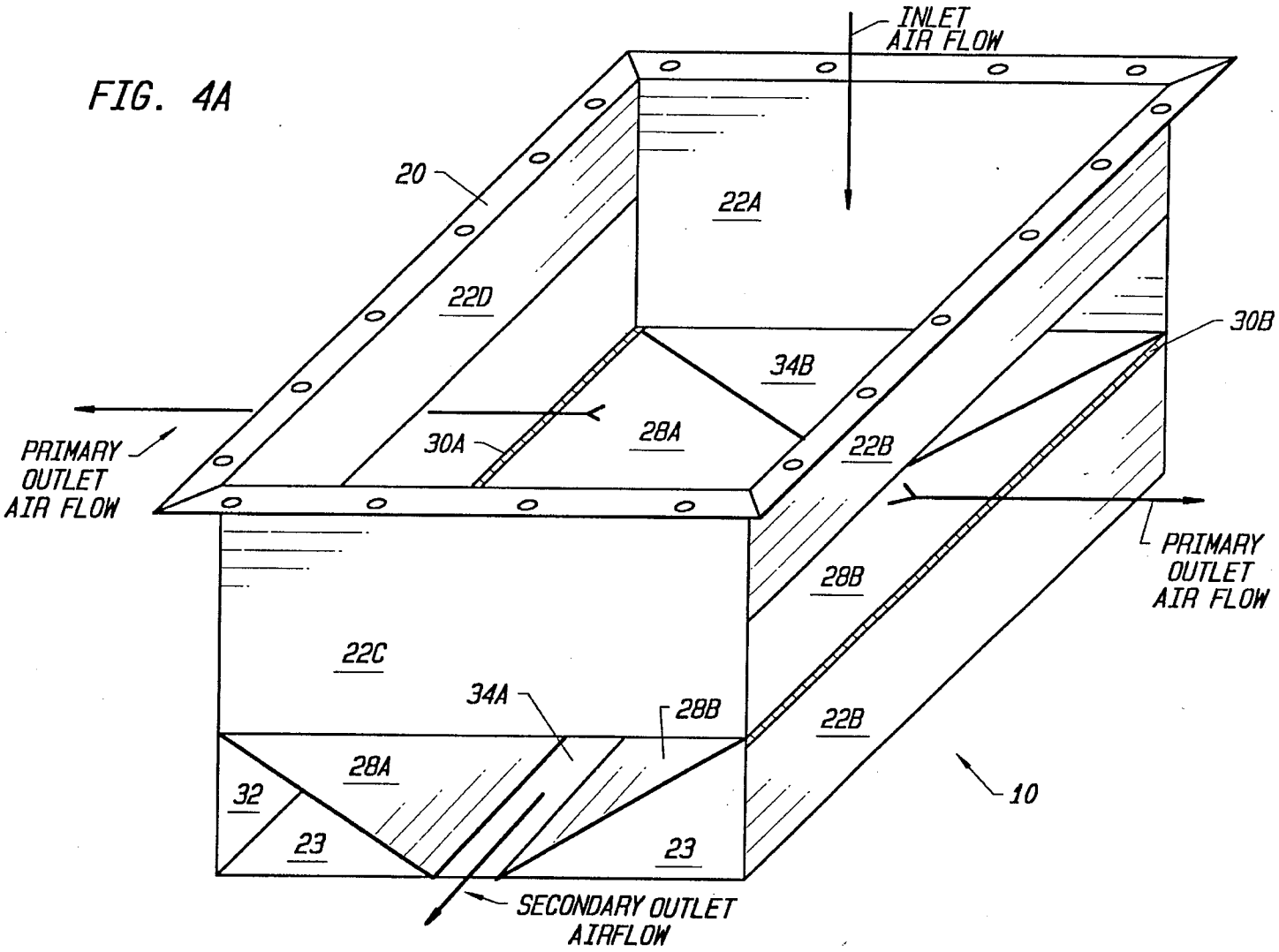
FIGS. 4A–4E illustrate various configurations for the secondary outlets of the invention.

FIG. 4A is a second perspective view of diffuser 10. This view shows first vane 28A and second vane 28B in an open position. First vane 28A and second vane 28B are shown in this figure as having swung downward on their respective hinges in the fashion of a double door to provide a passage through which air within diffuser 10 can pass into conditioned space 13. First secondary outlet 34A is visible in the foreground of FIG. 4 located at what would correspond to the front face of a cube. Also present but not visible from the perspective of this figure is second secondary outlet 34B which is located at what would correspond to the rear face of a cube. The arrow in the foreground pointing towards the viewer of the figure illustrates secondary outlet air flow through first secondary outlet 34A. Secondary outlet 34B has a shape and size that are equal to that of primary outlet 34A. Not visible from this view is air flow through second secondary outlet 34B which is approximately equal to that flowing through first secondary outlet 34A. It should be noted that diffuser 10 could be implemented with only a single secondary outlet. It can be observed that first secondary outlet 34A is an approximately triangular opening providing air flow that is in a direction that is perpendicular to air flow through first primary outlet 26A and perpendicular to second primary outlet 26B.

As shown in this figure, first vane 28A and second vane 28B are in a fully open position that permits maximum flow of air through first secondary outlet 34A and second secondary outlet 34B. This fully open position may be thought of as providing a predetermined maximum secondary area for the secondary outlets. In the fully closed position shown in FIG. 2, first vane 28A and second vane 28B prevent flow of air through first secondary outlet 34A and through second secondary outlet 34B. This fully closed position may be thought of as providing a predetermined minimum secondary area for the secondary outlets.

The position of first vane 28A and second vane 28B between the predetermined minimum secondary area and the predetermined maximum secondary area is determined by positioning means. The positioning means, by way of example, can be implemented with a return spring or counter weight.

Figure 4B:
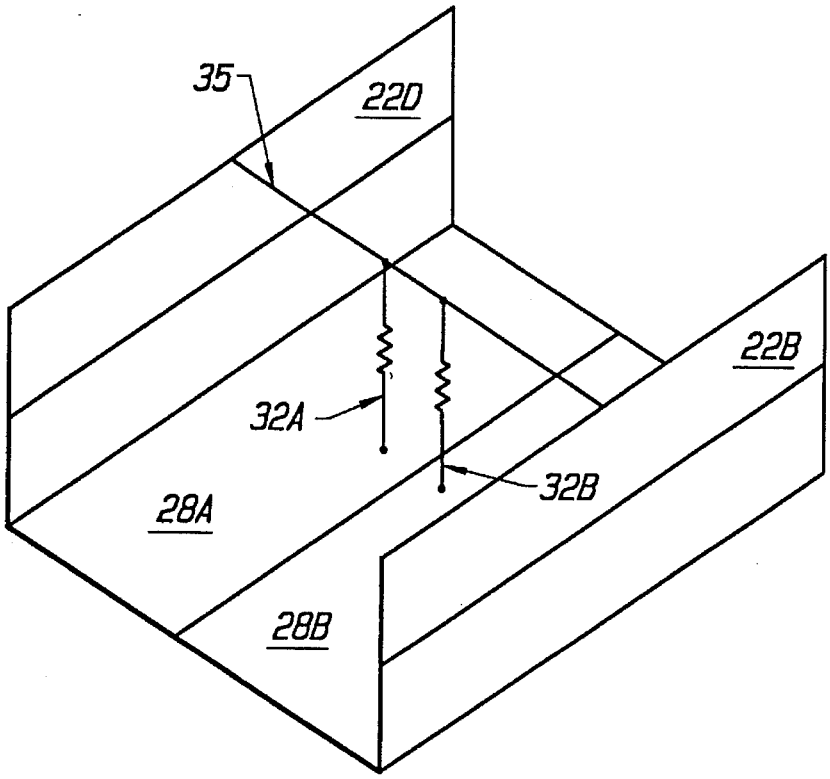
Figure 4C:
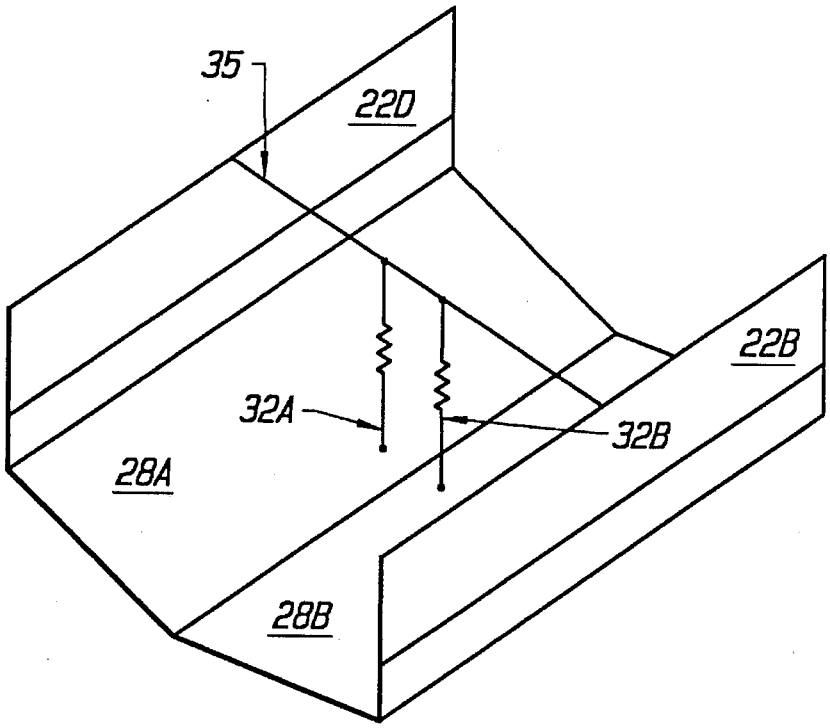

The positioning means implemented as a return spring is shown in FIG. 4B. The springs 32A and 32B are anchored to a spring support bar 35. Spring support bar 35 is attached to the diffuser body 22 at each of its ends. Spring 32A is also anchored to first vane 28A directly below the spring support bar 35, while spring 32B is anchored to second vane 28B directly below the spring support bar 35. The vanes 28 and spring components 32 are shown in a fully closed position in FIG. 4B. FIG. 4C shows the vanes 28 and spring components 32 in a fully open position.

Figure 4D:
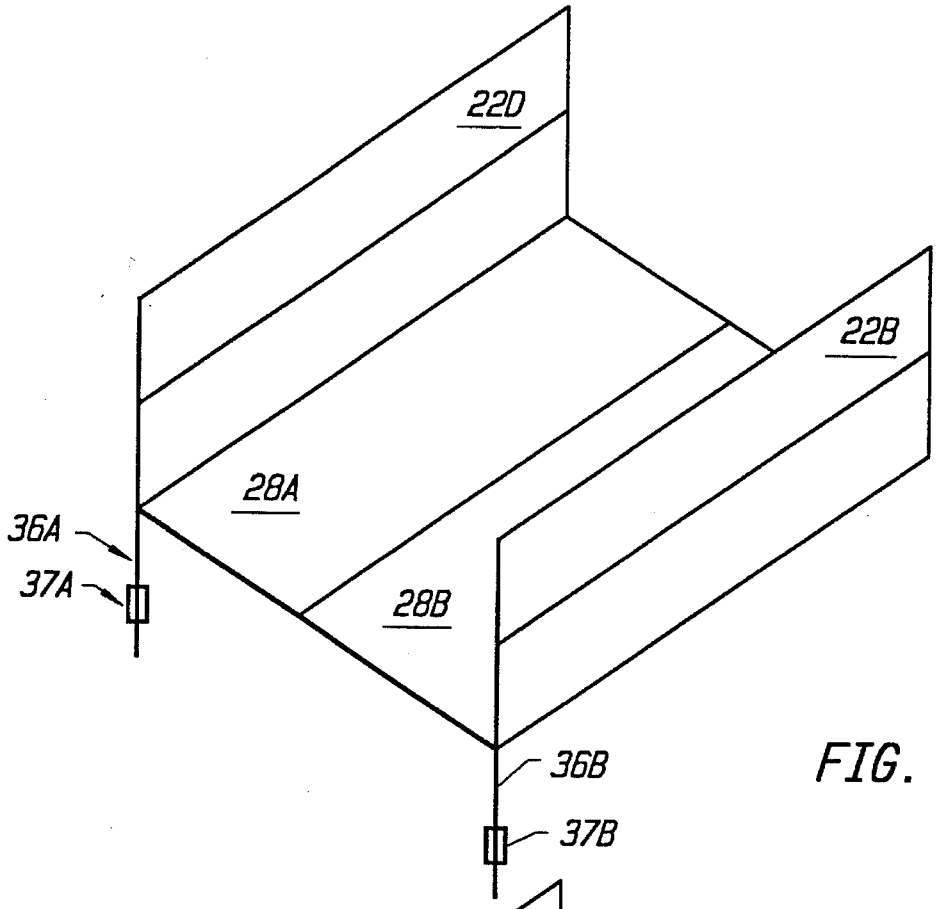
Figure 4E:
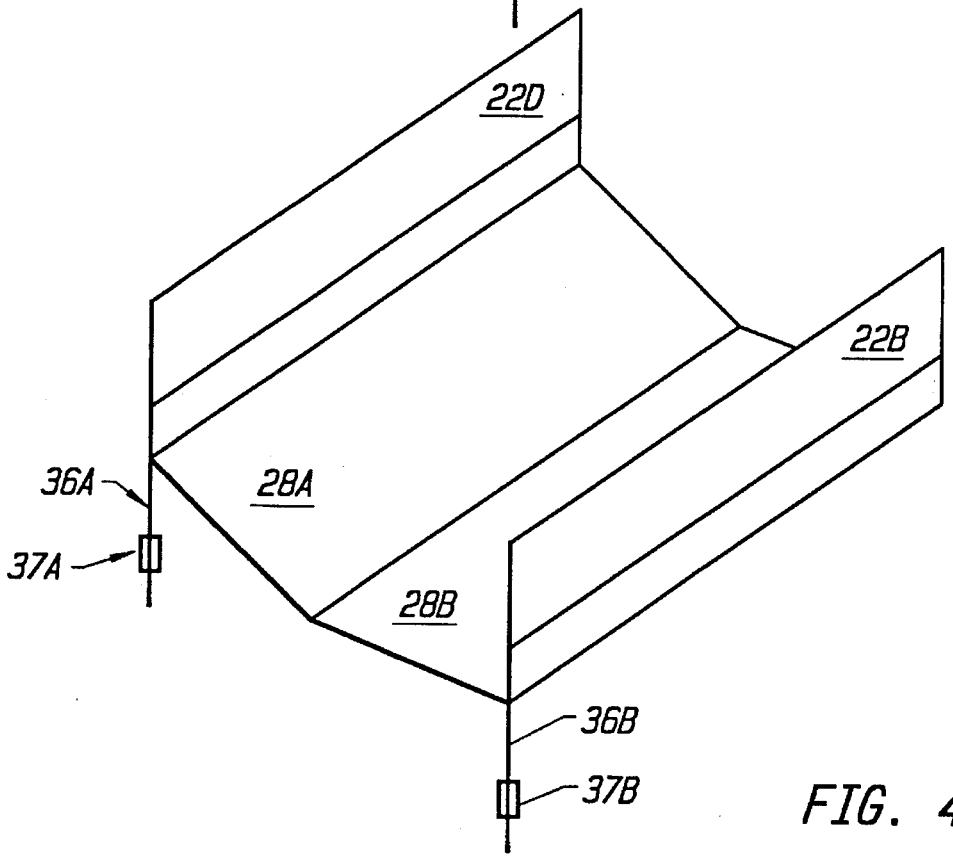

The positioning means implemented as a counterweight is shown in FIG. 4D. The counterweight for vane 28A consists of a connecting rod 36A upon which is mounted a balancing weight 37A. The counterweight for vane 28B consists of a connecting rod 36B upon which is mounted a balancing weight 37B. The position of the balancing weights 37A and 37B can be changed by sliding the weights along their respective connecting rods 36A and 36B. The vanes and spring components are shown in a fully closed position in FIG. 4D, and a fully open position in FIG. 4E.

Figure 5A:
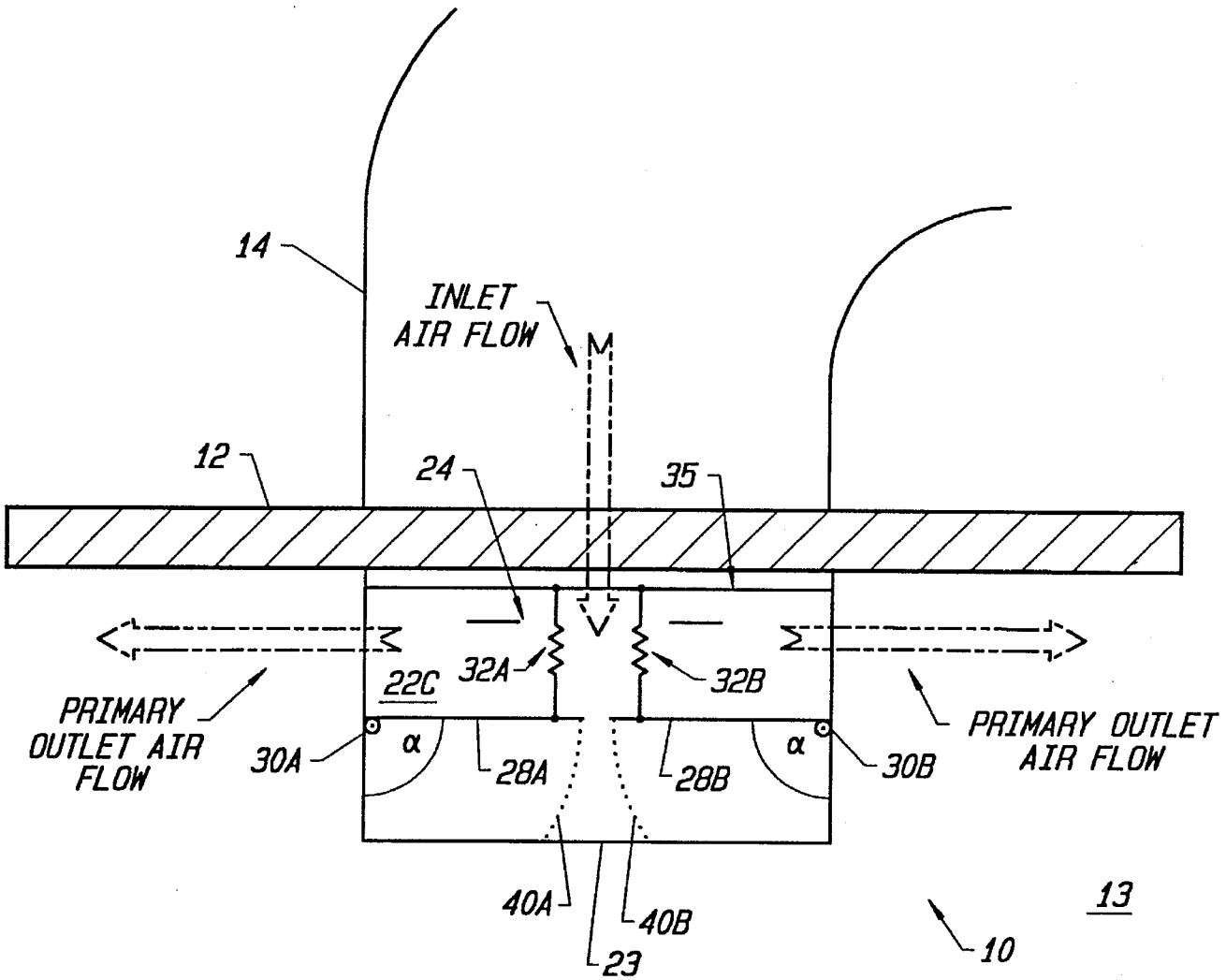
FIGS. 5A–5B are sectional side views of the diffuser taken along the line 5—5 of FIG. 3, respectively showing closed and open secondary outlets.

FIG. 5A is a sectional side view of the diffuser 10 taken along the line 5—5 of FIG. 3, so as to illustrate closed secondary outlets. First vane 28A can swing through the dotted arc 40A. Similarly, second vane 28B can swing through the dotted arc 40B. FIG. 5A also illustrates return springs 32A and 32B, which are in a contracted position. The upper anchor points of the springs are attached to support bar 35, while the lower anchor points are attached to vanes 28A and 28B.

As can be appreciated with reference to FIG. 5A, diffuser 10 has a means for automatically adjusting the size of the secondary area, as defined by the first secondary outlet 34A and the second secondary outlet 34B. The means for automatically adjusting the size of the secondary area operates such that the secondary area has the minimum sized secondary area when air entering inlet 24 has a flow rate that is lower than a threshold flow rate, and such that the secondary outlet area has the maximum secondary area when air entering inlet 24 has a flow rate that is higher than a second flow rate, which is higher than the threshold flow rate. The minimum sized secondary area is illustrated in this figure since first vane 28A and second vane 28B are in their fully closed position. The angle alpha between first vane 28A and diffuser body 22 is approximately ninety degrees in this figure. This angle decreases as first vane 28A swings downward to adjust the size of the secondary area. The corresponding angle for the second vane 28B simultaneously decreases to the same value as the angle for the first vane 28B, since the first vane 28A and the second vane 28B are similar in size and other respects and since the return means, in this case springs 32A and 32B, are the same.

The means for automatically adjusting the secondary area operates such that when air entering the inlet has a flow rate that is between the threshold and second flow rates, the secondary outlet area increases (and the angle alpha decreases) in response to increases in the flow rate of air entering the inlet and decreases in response to decreases in the flow rate of air entering the inlet. In the embodiment illustrated in FIG. 5A, the means for automatically adjusting first vane 28A and second vane 28B are disposed such that air that has entered inlet 24 impinges upon the vanes and such that an increase in the flow rate of air entering inlet 24 causes the impinging air to swing the vanes downward (decreasing the angle alpha) such that the secondary area is increased.

The means for automatically adjusting the secondary area includes biasing means acting upon first vane 28A to urge the first vane 28A to swing in opposition to the impinging air such that the secondary area is decreased in response to reductions in the flow rate of air entering inlet 24. A similar biasing means is provided for second vane 28B. This biasing means is illustrated as first spring 32A and second spring 32B which act respectively on first vane 28A and second vane 28B.

It should be understood that inlet air flow is represented by the vertical arrow in FIG. 5A. Air flow from diffuser 10 into conditioned space 13 is indicated by the leftward and rightward pointing arrows. These leftward and rightward pointing arrows indicate air flow through first primary outlet 26A and second primary outlet 26B. Essentially no air flows through first secondary outlet 34A or second secondary outlet 34B since first vane 28A and second vane 28B are in their closed position.

Figure 5B:
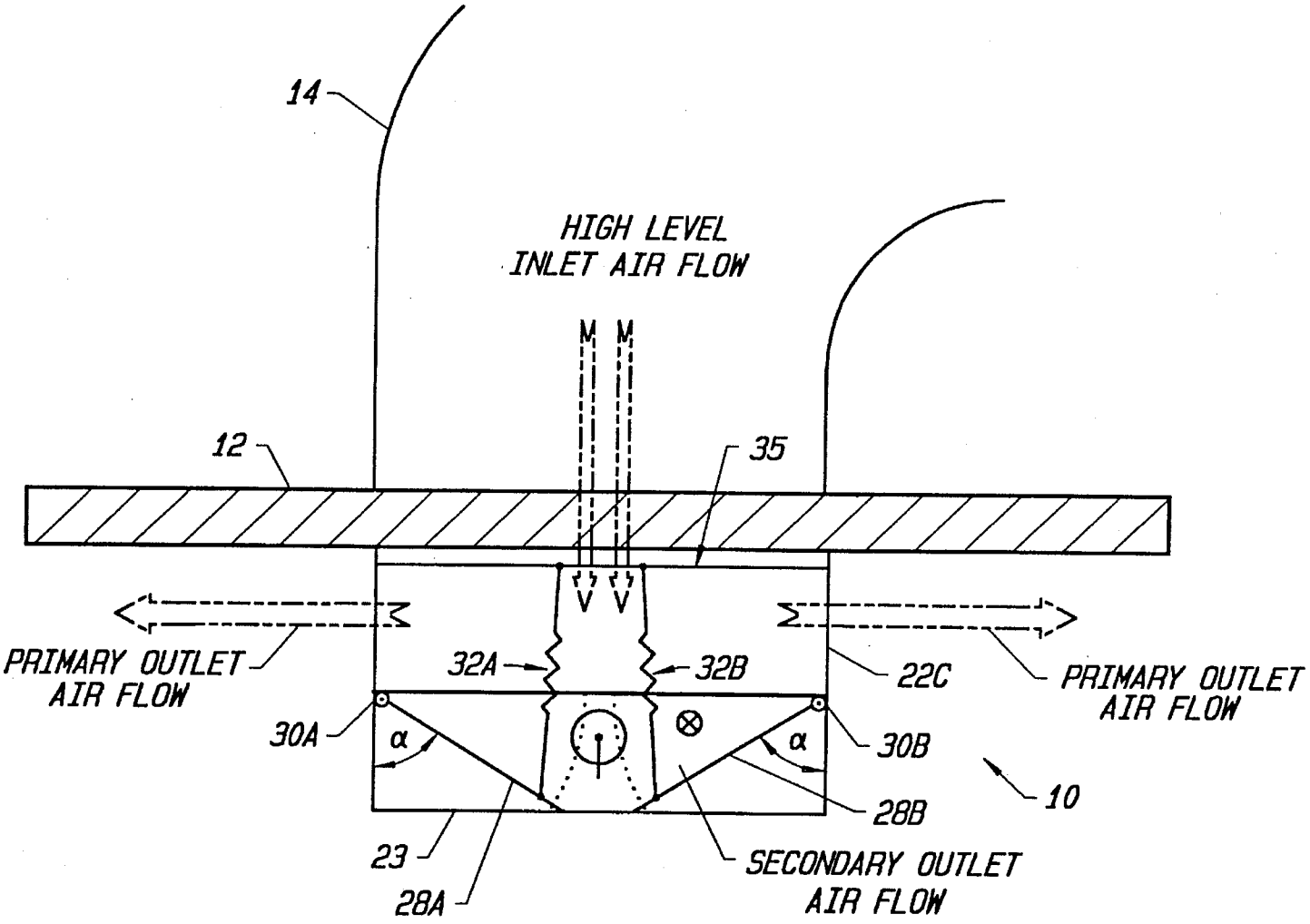

FIG. 5B is a sectional side view of the diffuser 10 so as to illustrate open secondary outlets. In this figure, first vane 28A is shown as having swung through the dotted arc which extends from the edge of vane that is distant from first hinge 30A. Similarly, second vane 28B is shown as having swung through the dotted arc which extends from the edge of vane that is distant from second hinge 30B. The angle alpha has been decreased as compared to the angle alpha of FIG. 5A. It should be noted that the angle alpha for both first vane 28A and second vane 28B remains approximately equal for the reasons set forth above.

The positioning means embodied as return springs 32A and 32B are shown in FIG. 5B. The return springs 32A and 32B are drawn in a fully extended position. The upper anchor points to the springs, affixed to spring support bar 35, have not moved, but the lower anchor points, attached to vanes 32A and 32B, respectively, are at a lower position.

It should be understood that inlet air flow is represented by the vertical arrow in FIG. 5B. Air flow from diffuser 10 into conditioned space 13 is indicated by the leftward and rightward pointing arrows. These leftward and rightward pointing arrows indicate air flow through first primary outlet 26A and second primary outlet 26B.

Air flow from diffuser 10 into conditioned space 13 is also indicated by the circled point to indicate air flow in the direction of out of the page towards the viewer. This circled point indicates air flow through first secondary outlet 34A.

Air flow from diffuser 10 into conditioned space 13 is also indicated by the circled "X" to indicate air flow in the direction into the page, away from the viewer. This circled X indicates air flow through second secondary outlet 34B.

While FIG. 5B illustrates first vane 28A and second vane 28B in their fully opened position, it should be understood that their position between their fully closed and fully opened orientations can be at any point along the arcs indicated in FIGS. 5A or 5B. The particular position along the arcs that the vanes take depends upon the equilibrium reached by opposing forces provided by air entering inlet 24 impinging upon the vanes and by the first spring 32A and second spring 32B or counterweights 37A and 37B, as these positioning means act on their respective vanes. The particular position taken by the vanes will depend upon the spring constants of first spring 32A and second spring 32B, or the moment formed by the product of the weight of counterweights 37A and 37B and the distance from the hinge along the connecting rods 36A and 36B.

At whatever position first vane 28A and second vane 28B take along the arcs between their fully closed and fully opened positions, at least a portion of the vanes define at least a portion of first secondary outlet 26A and second secondary outlet 26B. Each of the possible partially and fully open positions that may be taken by first vane 28A and second vane 28B result in essentially triangular shapes for first secondary outlet 26A and second secondary outlet 26B. When first vane 28A and second vane 28B are partially or fully open, some air will pass through a rectangular opening defined by the close edges of first vane 28A and second vane 28B. Such air will be channeled in the same direction as the secondary air flow through first secondary outlet 26A and second secondary outlet 26B into conditioned space 13.

In the illustrated embodiment, the relative size of a primary outlet is 200% of the size of a secondary outlet when the vanes are in their fully open position.

Figure 6:
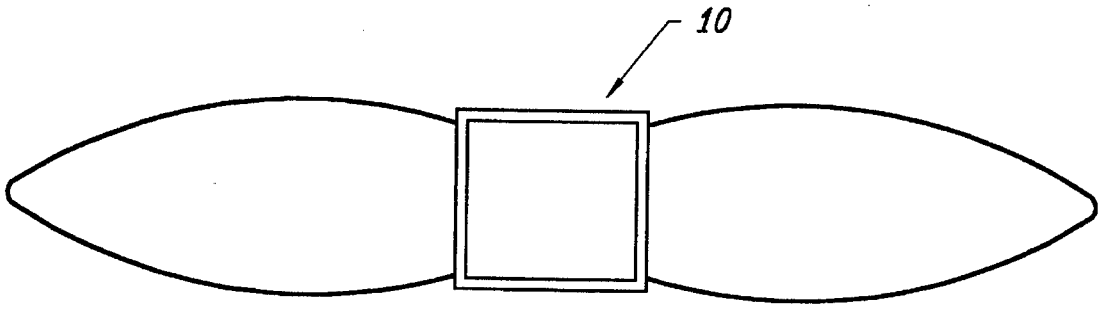
FIG. 6 is a schematic which illustrates the two-way throw pattern provided by the diffuser when secondary outlets are fully closed.

FIG. 6 is a schematic which illustrates the two-way throw pattern provided by diffuser 10 when first secondary outlet 34A and second secondary outlet 34B are fully closed. This schematic is illustrated from the same view as FIG. 3. Thus the throw pattern on the left side of diffuser 10 illustrates air exiting first primary outlet 26A while the throw pattern on the right side of diffuser 10 illustrates air exiting second primary outlet 26B.

Figure 7:
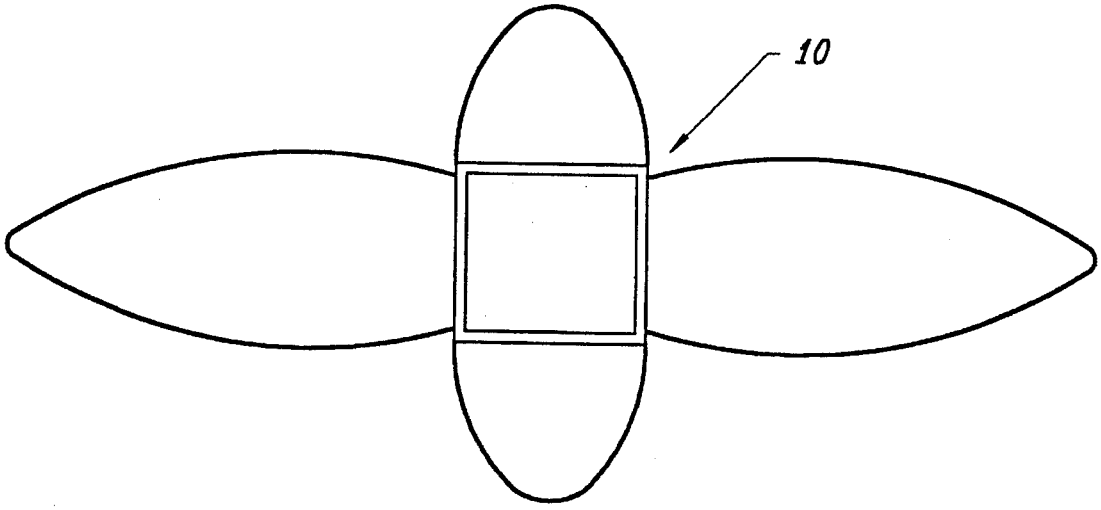
FIG. 7 is a schematic which illustrates the four-way throw pattern provided by the diffuser when secondary outlets are fully open.

FIG. 7 is a schematic which illustrates the four-way throw pattern provided by the diffuser 10 when first secondary outlet 34A and second secondary outlet 34B are fully open. This schematic is illustrated from the same view as FIG. 3. Thus the throw pattern on the lower side of diffuser 10 illustrates air exiting first secondary outlet 34A while the throw pattern on the right side of diffuser 10 illustrates air exiting second secondary outlet 34B.

Figure 8:
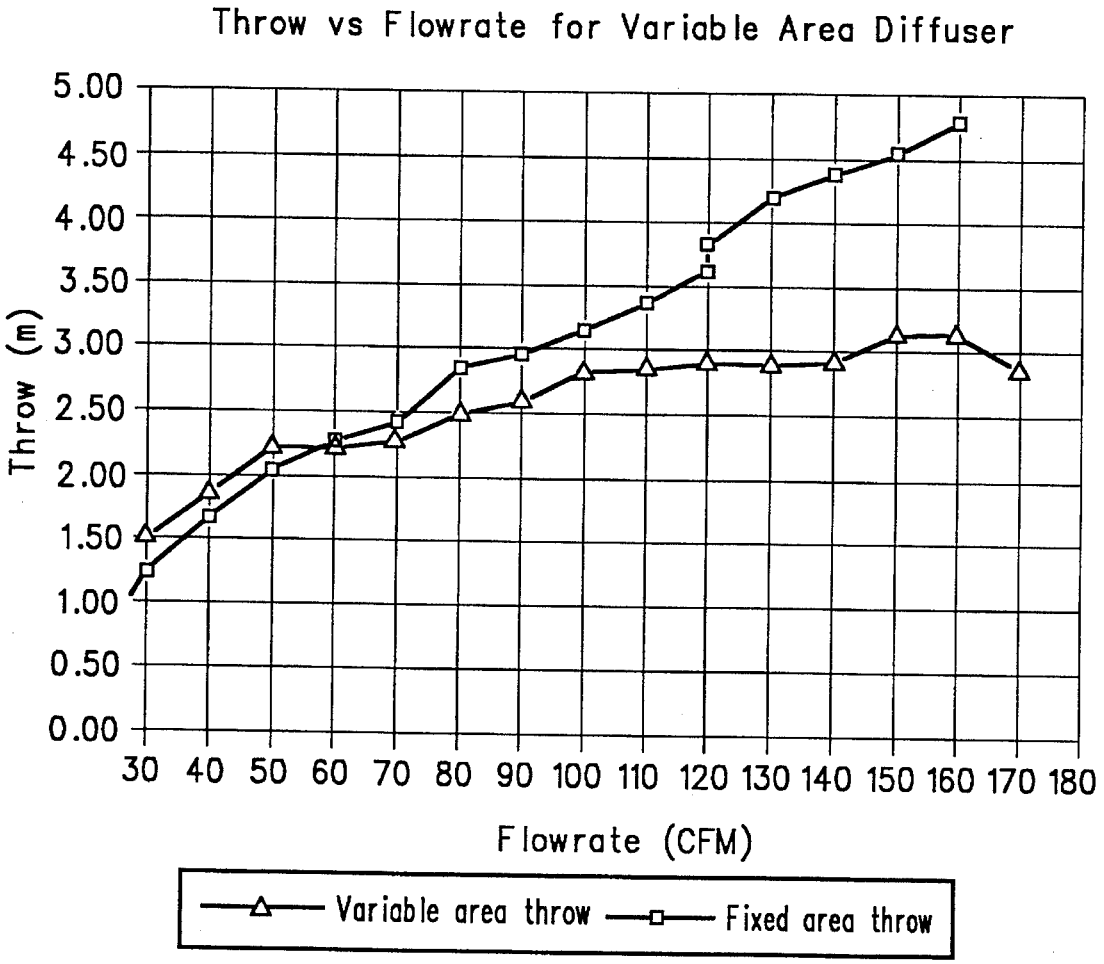
FIG. 8 is a chart which illustrates throw as a function of flowrate for the diffuser of the present invention and for a prior art diffuser.

FIG. 8 is a chart which illustrates measurements of the throw from the first primary outlet 26A as a function of flowrate for the diffuser of the present invention and for a prior art diffuser having a fixed throw area. Diffuser 10 was configured so that secondary outlets 34A and 34B begin to open at a flow rate above 30 cubic feet per minute (cfm) and they are fully open at a flow rate of 170 cfm. The slope of the throw versus flowrate curve of the diffuser of the present invention is less than that for a fixed area diffuser which indicates that the throw of the diffuser of the present invention is being maintained at a relatively constant value. The relatively constant value is desired since excessive throw can result in uncomfortable environmental conditions within conditioned space 13.

Figure 9:
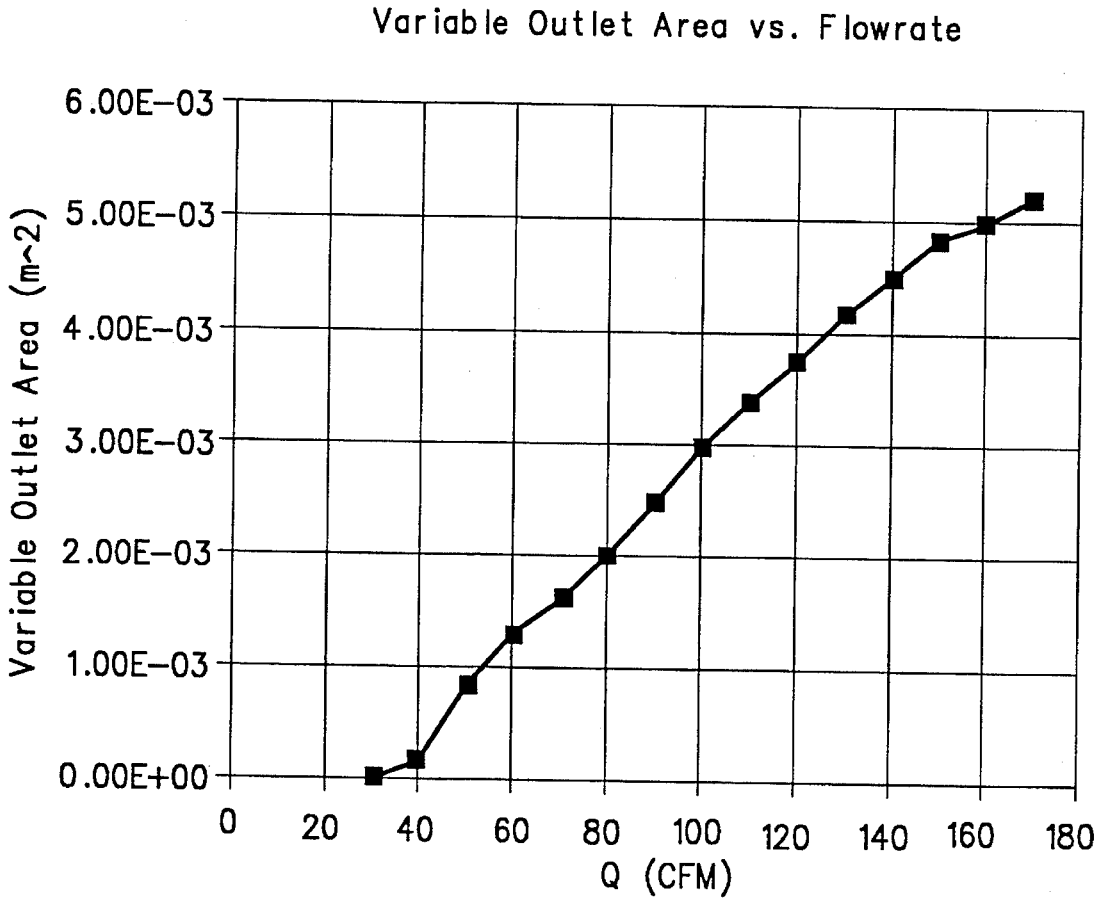
FIG. 9 is a chart which illustrates the area size of the secondary outlet of the diffuser of the invention as a function of flowrate.

FIG. 9 is a chart which illustrates the area size of one secondary outlet of the diffuser as a function of flowrate. The triangular secondary outlets did not open until after 30 cfm. The maximum outlet area was reached at about 170 cfm. The linearity of the slope of the line shows that the relatively constant throw from the primary outlets is a result of the linear increase in the secondary outlet areas as the flowrate is increased.

Persons skilled in the art of the present invention may, upon exposure to the teachings herein, conceive other variations. Such variations are deemed to be encompassed by the disclosure, the invention being limited only by appended claims.

I claim:

1. A diffuser (10) for introducing air into a conditioned space (13) to obtain a desired indoor atmospheric environment, the diffuser comprising:

(a) a diffuser body (22);

(b) an inlet (24) through the diffuser body, the inlet having an inlet area to receive the air within the diffuser;

(c) a primary outlet (26A, 26B) through the diffuser body and terminating in the conditioned space, the primary outlet having a fixed primary area to direct air from within the diffuser into the conditioned space; and (d) a secondary outlet (34A, 34B) through the diffuser body and terminating in the conditioned space, the secondary outlet to direct the air from within the diffuser into the conditioned space, the secondary outlet having an associated secondary area that is adjustable in size between a predetermined minimum secondary area and a predetermined maximum secondary area.

2. A diffuser as in claim 1 further comprising means for automatically adjusting the secondary area.

3. A diffuser as in claim 2 wherein the means for automatically adjusting the secondary area operates such that the secondary area has the minimum secondary area when air entering the inlet has a flow rate that is lower than a threshold flow rate, and such that the secondary outlet area has the maximum secondary area when air entering the inlet has a flow rate that is higher than a second flow rate which is higher than the threshold flow rate.

4. A diffuser as in claim 3 wherein the means for automatically adjusting the secondary area operates such that when air entering the inlet has a flow rate that is between said threshold and second flow rates, said secondary outlet area increases in response to increases in the flow rate of air entering the inlet and decreases in response to decreases in the flow rate of air entering the inlet.

5. A diffuser as in claim 4 wherein said means for automatically adjusting the secondary area includes a vane (28A) that is movably fastened within the diffuser body such that a portion of the vane defines at least a portion of the secondary outlet and such that movement of the vane changes the size of the secondary outlet area.

6. A diffuser as in claim 5 wherein the vane is disposed such that air that has entered the inlet impinges upon the vane and such that an increase in the flow rate of air entering the inlet causes the impinging air to move the vane such that the secondary area is increased.

7. A diffuser as in claim 6 wherein the means for automatically adjusting the secondary area includes biasing means acting upon the vane to urge the vane to move such that the secondary area is decreased.

8. A diffuser as in claim 7 wherein the biasing means is a spring (32A) acting upon the vane.

9. A diffuser as in claim 7 wherein the biasing means is a counterweight 37A.

10. A diffuser as in claim 3 wherein the primary outlet has a shape that is substantially rectangular and the secondary outlet has a shape that is substantially triangular.

11. A diffuser as in claim 4 wherein said means for automatically adjusting the secondary area includes a first vane (28A) and a second vane (28B);

the first vane being movably fastened within the diffuser body and disposed such that air that has entered the inlet impinges upon the first vane and such that an increase in the flow rate of air entering the inlet causes the impinging air to move the first vane such that the secondary area is increased, the first vane provided with biasing means acting upon the first vane to urge the first vane to move such that the secondary area is decreased;

the second vane being movably fastened within the diffuser body and disposed such that air that has entered the inlet impinges upon the second vane and such that an increase in the flow rate of air entering the inlet causes the impinging air to move the second vane such that the secondary area is increased, the second vane provided with biasing means acting upon the second vane to urge the second vane to move such that the secondary area is decreased;

such that a portion of the first vane and a portion of the second vane define at least a portion of the secondary outlet and such that movement of the first vane and the second vane changes the secondary outlet size.

12. A diffuser as in claim 4 having a plurality of primary outlets.

13. A diffuser as in claim 4 having a plurality of secondary outlets.

14. A diffuser as in claim 4 having two rectangular shaped primary outlets which direct air in opposite primary outlet directions and having two triangular shaped secondary outlets which direct air in opposite secondary outlet directions which opposite secondary outlet directions are oriented at right angles to the primary outlet directions.

15. An air diffuser for distributing air from an air supply mechanism into a conditioned space, comprising:

a diffuser body defining an inlet to receive air from said air supply mechanism;

a primary outlet extending into said conditioned space, said primary outlet having a fixed primary area to direct said air from said air supply mechanism into said conditioned space; and a secondary outlet extending into said conditioned space, said secondary outlet having an area whose size changes in response to the rate at which said air from said air supply is received at said inlet.

16. The air diffuser of claim 15 wherein said primary outlet directs said air into said conditioned space in a first direction and said secondary outlet directs said air into said conditioned space in a second direction, substantially perpendicular to said first direction.

17. An air diffuser for distributing air from an air supply mechanism into a conditioned space, comprising:

a box-like structure with a first wall, a second wall, a third wall, and a fourth wall defining an inlet on a first side and supporting a first floor segment and a second floor segment on an opposite side, said first floor segment including a first floor segment pivot side pivotally connected to a first side of said third wall and a first side of said fourth wall, and a first floor segment opening side opposite said pivot side, said second floor segment including a second floor segment pivot side pivotally connected to a second side of said third wall and a second side of said fourth wall, and a second floor segment opening side opposite said pivot side, said first wall and said first floor segment pivot side defining a first fixed primary outlet, said second wall and said second floor segment pivot side defining a second fixed primary outlet, said first floor segment opening side and said second floor segment opening side forming a variable area secondary outlet in response to the air flow rate from said air supply mechanism.

18. The air diffuser of claim 17 wherein said primary outlet directs said air into said conditioned space in a first direction and said variable area secondary outlet directs said air into said conditioned space in a second direction, substantially perpendicular to said first direction.

* * * * *